United States Patent [19]

Stambaugh et al.

[11] 4,092,125

[45] May 30, 1978

[54] TREATING SOLID FUEL

[75] Inventors: Edgel P. Stambaugh; Satya P. Chauhan, both of Worthington, Ohio

[73] Assignee: Battelle Development Corporation, Columbus, Ohio

[21] Appl. No.: 754,153

[22] Filed: Dec. 27, 1976

Related U.S. Application Data

[63] Continuation of Ser. No. 563,837, Mar. 31, 1975, abandoned.

[51] Int. Cl.[2] ..... C10L 9/10; C10B 57/00

[52] U.S. Cl. ..... 44/1 R; 48/210; 201/17

[58] Field of Search ..... 44/1 R; 201/17; 48/202, 48/197 R, 210

[56] References Cited

U.S. PATENT DOCUMENTS

| | | | |
|---|---|---|---|
| 44,817 | 10/1864 | Penniman | 44/1 R |
| 1,007,153 | 10/1911 | Spurrier | 44/1 R |
| 2,162,221 | 6/1939 | Kasehagen et al. | 44/1 R |
| 3,723,291 | 3/1973 | Thakker | 201/17 X |
| 3,909,213 | 9/1975 | Sanders | 44/1 R |
| 3,970,434 | 6/1976 | Gasior et al. | 44/1 F |
| 3,993,455 | 11/1976 | Reggel et al. | 44/1 R |

*Primary Examiner*—Carl F. Dees

*Attorney, Agent, or Firm*—Philip M. Dunson; Thomas W. Winland; C. Henry Peterson

[57] ABSTRACT

A method of treating fine particles of solid carbonaceous fuel of the coal or coke type that comprises mixing the fuel particles with a liquid aqueous solution comprising essentially (a) sodium, potassium, or lithium hydroxide together with (b) calcium, magnesium, or barium hydroxide or carbonate, or a plurality thereof, with a ratio of (a) to the fuel of about 0.04 to 0.70 (typically 0.10 to 0.35) by weight, a ratio of (b) to the fuel of about 0.02 to 0.30 (typically 0.08 to 0.20) by weight, and a ratio of water to the fuel of about 1 to 10 (typically 2 to 5) by weight; heating the resulting mixture, at an elevated pressure, to a temperature of about 150° to 375° C (typically 175° to 300° C) in such a manner as to improve the usefulness of the fuel particles; and cooling to below about 100° C. The cooled mixture either is dried or filtered to separate the fuel particles from the solution, the particles then being washed and dried. The filtered solution is regenerated so that it can be again mixed with unreacted fuel particles. The solution typically comprises essentially sodium hydroxide and calcium hydroxide or carbonate, and may comprise also magnesium hydroxide or carbonate.

39 Claims, 5 Drawing Figures

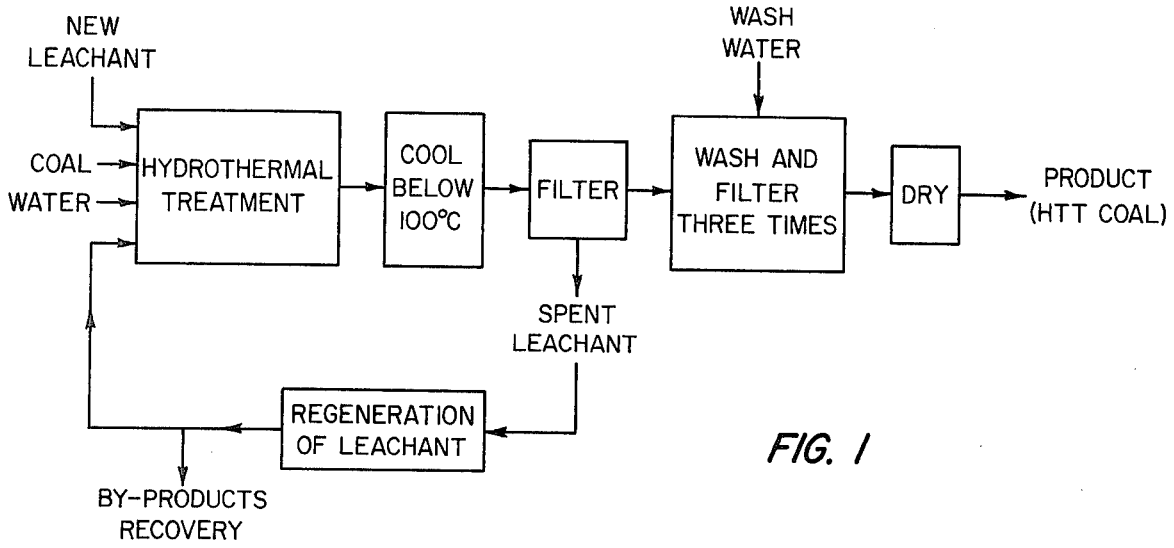
FIG. 1
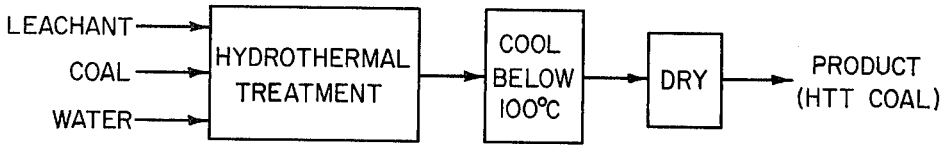
FIG. 2
FIG. 3
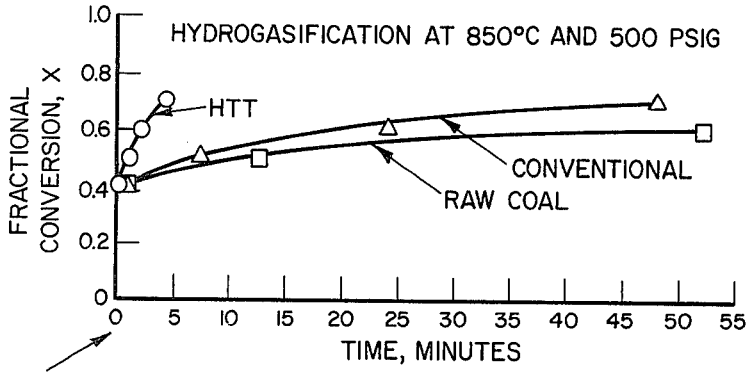
COMPARISON OF THE REACTIVITY OF HTT COAL WITH RAW COAL AND A COAL THAT WAS CONVENTIONALLY-IMPREGNATED WITH CATALYST
FIG. 4
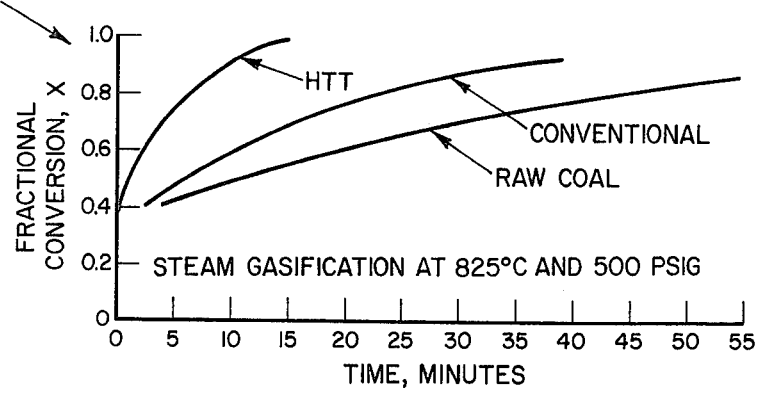

TREATING SOLID FUEL

This is a continuation of our copending application Ser. No. 563,837, filed Mar. 31, 1975, and now abandoned for Treating Solid Fuel.

BACKGROUND OF THE INVENTION

In many areas of the United States natural gas shortages are threatening to strangle industry to a degree that could be much more severe than the widely publicized Arab oil embargo. For example, this winter of 1974–1975 in many midwestern states industrial users will receive only about one-half of last year's allotment of natural gas. Unfortunately, according to the most credible projections available, the natural gas supply situation will not improve. Therefore, for the intermediate and long term, synthesis gas, hereinafter SNG, will have to play a larger role if anything near our present industrial and general life style is to be maintained.

However, for SNG to provide a significant portion of our total gas needs great amounts of capital will have to be made available that would otherwise be used for alternate purposes, requiring much higher costs to the consumer.

To reduce the impact of an SNG industry on our fuel costs will require the development of technology that allows lowering capital and operating costs substantially below that required for the current and heretofore proposed systems for coal gasification. The present invention comprises a method of treating coal which permits conversion of coal to SNG under previously unobtainable conditions that allow substantial reductions to be made in plant investment and operating costs.

Work on coal gasification process development has been going on for years. For example, the Lurgi process was first operated commercially in 1936 and the Winkler process was used on a commercial scale in the 1920's. However, commercialization of synthesis gas-from-coal processes never became important in the U.S. because of the large Texas gas and oil fields coming into production shortly after World War II.

It is well recognized that coal gasification technology could benefit considerably by the development of suitable coal gasification catalysts. Numerous attempts have been made since the beginning of this century to catalyze the reaction of coal and other carbonaceous matter with steam. A few attempts have also been made recently to catalyze the reaction of coal and other carbonaceous matter with hydrogen, hereinafter termed hydrogasification, because of the increased interest in producing methane from coal.

In the 1920's Taylor and Neville reported data on the effect of several catalysts on the steam-carbon reaction at 490°–570° C showing that the most effective catalysts were potassium and sodium carbonate, and Kroger found that metallic oxides and alkali carbonates or mixtures catalyzed the steam-carbon reaction.

While the catalytic and noncatalytic steam-carbon reactions had been studied in fair detail before 1940, little had been studied on the reaction of carbon with hydrogen. In 1937, Dent was the first to report on methane formation by the reaction of hydrogen with coke and coal, hydrogasification, at elevated temperatures and pressures. Dent's work did not involve the use of a catalyst.

Several studies have been conducted since 1960 on the catalysis of hydrogasification reactions involving carbonaceous matter and various oxidizing and reducing gases. Wood and Hill reported that the hydrogasification of coals and cokes at 800°–900° C is catalyzed by 1–10 weight percent alkali carbonates. The increased hydrogasification rates have been attributed to the prevention of graphitization of the reaction surface due to adsorption of alkalies. Le Francois has recently described a process that uses molten sodium carbonate as a catalyst for the steam-coal reaction. Very high ratios of molten salt to coal are required since the molten salt is the continuous phase.

Haynes, Gasior, and Forney have been working on the high-pressure catalytic gasification of coal with steam. In their bench-scale experiments at 850° C and 300 psig they found that alkali metal compounds increased the carbon gasification the most, by 31–66 percent. The catalyst concentration was 5 weight percent of coal in all cases. The coal was high-volatile bituminous coal (Bruceton, Pennsylvania) that had been pretreated at 450° C with a steam-air mixture to make it noncaking. They also found that 20 different metal oxides, including CaO, increased carbon gasification by 20–30 percent.

The latter works conducted some pilot plant experiments in the Synthane gasifier at 907°–945° C and 40 atmospheres, and found that a 5-weight percent "addition" to the coal of either dolomite or hydrated lime resulted in significant increases in the amount of carbon gasified and in the amount of $CH_4$, CO, and $H_2$ produced.

In all of the above-described prior art only two methods for impregnation of coal with a catalyst have been used: (a) physical admixing of catalyst to coal, or (b) soaking of coal in an aqueous solution of catalyst at room temperature and then drying the slurry.

The present invention involves the chemical and physical incorporation of a suitable gasification catalyst in coal by hydrothermally treating the coal. Gasification tests of coal treated according to the present invention indicate that this coal has a reactivity far above that predictable from the results of the investigations described above. Coal treated according to the present invention is a much better feedstock for gasification than either raw coal or coal impregnated with comparable quantities of catalysts according to the prior art.

The following are the improved characteristics of coal treated according to the present invention, which can result in a number of advantages:

(1) A highly caking and swelling coal can be made completely non-caking and non-swelling without any significant loss of the volatile matter. This should result in (a) simpler reactor systems, (b) higher system reliability, and (c) more efficient coal utilization. (2) Hydrogasification of HTT coal proceeds at lower pressures which should result in (a) lowering of the investment cost and (b) higher system reliability. (3) Hydrogasification of HTT coal proceeds at higher rates which should result in (a) high direct yield of methane, (b) a compact reactor, and (c) in simplified gas purification.

(4) Steam gasification of HTT coal proceeds at a lower temperature which should result in (a) lower oxygen consumption for gasification, (b) increased methane formation, and (c) simpler gasifiers with reduced refractory problems.

(5) If one of the catalysts in HTT coal is calcium (or magnesium) oxide it acts as an efficient absorber of sulfur in coal which should allow the combustion of the char, from gasification, without stack gas scrubbing and should result in a reduced cost for the purification of the synthesis gas.

These advantages will result in the following benefits to the gas production industry:

(1) Reduced capital investment because of the lower pressure at which direct hydrogasification occurs as well as the simpler reactor systems possible.

(2) Reduced operating costs because of the lower oxygen consumption, more efficient coal utilization, and higher system reliability.

(3) Reduced time required to bring SNG plants on stream. Because of the lower operating pressure, steel plate availability will be higher, fabrication will be faster, and quicker deliveries can be anticipated for auxiliary plant equipment.

(4) Even the most highly caking eastern coals containing high levels of sulfur can be used, thereby resulting in a considerable reduction in the SNG transportation costs and allowing the utilization of coal that could not otherwise be used.

Coal is the major source of energy for the United States and will continue to be for many years. However, one of the problems with coal as the source of energy is its high sulfur, nitrogen, and ash content which includes significant quantities of toxic (hazardous) impurities such as mercury, beryllium, and arsenic. These materials find their way into the environment during the combustion of coal and thus constitute a health hazard through atmospheric and food chain consumption.

The three different classes of impurities—sulfur, nitrogen, and metal values—are found in coal in a variety of forms.

Sulfur occurs in coal chiefly in three forms: (*1*) inorganic, (2) sulfate, and (3) organic. A fourth form, elemental sulfur, is rare. Of the inorganic sulfur compounds, iron pyrite ($FeS_2$ with an isometric crystal form) and marcasite ($FeS_2$ with the orthorhombic crystal form) are the most common. Other inorganic sulfides, chalcopyrite-$CuFeS_2$, arsenopyrite-FeAsS, and stibnite-$Sb_2S_3$, have been found, but they are rare.

Of the two major inorganic sulfides, pyrite is the most common. It is found in coal as macroscopic and microscopic particles, as discrete grains, cavity fillings, fiber bundles, and agregates. The concentration of pyritic sulfur vary widely even within the same deposit. Normally, the concentration will vary from 0.2 to 3 percent (sulfur basis), depending on the location.

The most common sulfur is calcium sulfate. Sulfates of iron, copper, and magnesium may also occur, but they are not abundant. Normally coal contains less than 0.1 percent sulfate sulfur, although in heavily weathered coal it may be as much as 1 percent. Because of its normally low concentration it is of little concern in air pollution.

The third form of sulfur most prevalent in coal is organic sulfur. Since this sulfur is part of and is linked to the coal itself, positive identification of the organic sulfur compounds has not been possible. However, it is usually assumed that organic sulfur is in one of the following forms:

(1) Mercaptan or thiol, RSH
(2) Sulfide or thio-ether RSR'
(3) Disulfide, RSSR'
(4) Aromatic systems containing the thiophene ring. The sulfur could be present as δ-thiopyrone.

No definite relationship between the organic and pyritic sulfur contents of coal has been established. In typical U.S. coal, the organic sulfur may range from 20.8 to 83.6 percent of total sulfur and have a mean value of 51.2 percent of the total sulfur. The variation of the organic sulfur content of a coal bed from top to bottom is usually small. Pyritic sulfur content may vary greatly.

Nitrogen, like sulfur, is probably part of and linked to the coal. Eastern coals average about 1.4 percent nitrogen, but with a range of 0.7 to 2.5 percent.

Metal values make up the part of coal commonly referred to as ash. They are found in coal as macroscopic and microscopic particles as discrete particles, cavity fillings, and aggregates. Concentration ranges from a few percent to 15 or 20 percent.

Physical separation of these three constituents from coal is not satisfactory, as at best only a portion of them are removed. Furthermore, flue gas scrubbing is not entirely satisfactory as a means for sulfur and hazardous metals removal, as at the present stage of development such systems (primarily for sulfur emissions control) are only about 75% efficient, large quantities of sludges are formed which present a disposal problem, and the cost for flue gas scrubbing is high. Since the quantity of low-sulfur coal is limited and coal is our major source of energy, new or improved technology must be developed for cleaning coal prior to combustion to supply the United States with a clean coal and at the same time reduce the pollution of our environment. We have discovered that the majority of the sulfur and much of the ash including such toxic or hazardous metals as beryllium, boron, and lead can be extracted directly from the coal by treatment according to the present invention.

Previously proposed desulfurization processes have placed major emphasis on (1) the use of alkali and alkaline earth compounds at temperatures above the melting point of the compounds or at temperatures where the solid carbonaceous materials begin to decompose, (2) the use of steam or steam and air at slightly elevated temperatures, or (3) the use of high temperature (approximately 1000° C) in atmospheres of such gases as nitrogen, carbon monoxide, and methane. A number of patents teach the use of sodium hydroxide, calcium hydroxide or mixtures thereof at temperatures above the melting point of these materials. In some cases the reagents are added to the solid carbonaceous materials as aqueous solutions. However, the water is volatilized during desulfurization at the elevated temperatures. Other patents disclose the use of gases such as steam, nitrogen, hydrogen, hydrocarbons, carbon monoxide and ammonia, or mixtures thereof, at elevated temperatures to desulfurize solid carbonaceous materials.

In comparison with these processes, for example, there is no need, and in fact it is not desirabble, in the present invention to first solubilize the coal in order to extract the sulfur and ash constituents. Furthermore, the present invention provides superior results and advantages with solid carbonaceous fuel that would not be expected from the prior art relating to treatment of liquid coal extracts.

Reggel, L., Raymond., R., Wender, I., and Blaustein, B. D., in their article, "Preparation of Ash-Free, Pyrite-Free Coal by Mild Chemical Treatment" Preprints, Division of Fuel Chemistry, ACS, V. 17, No. 1, August, 1972, pp 44–48, discuss the removal of pyritic sulfur from coal by treatment with a 0.10 N aqueous solution of either sodium hydroxide or calcium hydroxide individually for 2 hours at a temperature of 225° C. However, they do not discuss treatment with a mixed alkali solution, nor do they recognize the unique benefits arising from such treatment. More particularly, we have discovered, and they fail to recognize, that treatment with a mixed alkali solution according to the present invention results in: (1) the removal of a substantial amount of the organic, as well as the pyritic, sulfur from the coal, thus generally resulting in a coal having a lower total sulfur content than coal treated according to Reggel, et al.; (2) an unexpectedly great increase in the gasification reactivity of the coal; (3) an unexpectedly great decrease in the sodium content of the coal; and, (4) generally, a decrease in the required length of the treatment time.

SUMMARY OF THE INVENTION

A typical method according to the present invention for treating fine particles of solid carbonaceous fuel of the coal or coke type comprises, mixing the fuel particles with a liquid aqueous solution comprising essentially (a) sodium, potassium, or lithium hydroxide together with (b) calcium, magnesium, or barium hydroxide or carbonate, or a plurality thereof, with a ratio of (a) to the fuel of about 0.04 to 0.70 by weight, a ratio of (b) to the fuel of about 0.02 to 0.30 by weight, and a ratio of water to the fuel of about 1 to 10 by weight; and heating the resulting mixture, at an elevated pressure, to a temperature of about 150° to 375° C in such a manner as to improve the usefulness of the fuel particles.

Typically, the mixture is subsequently cooled to below about 100° C. The cooled mixture may be filtered to separate the fuel particles from the solution, and the filtered fuel particles may be subsequently washed and then dried. (Or the cooled mixture itself may be dried, and the filtering and washing omitted.) The filtered solution typically is regenerated so that it can be again mixed with unreacted fuel particles.

The treatment typically is substantially continuous, comprising the steps of (a) continuously intoducing the fuel particles at a preselected rate into the liquid aqueous solution to form a slurry, (b) moving the slurry through a region maintained at the elevated pressure and temperature, (c) moving the slurry outside the region of step (b) and separating the easily removable liquid phase from the solid fuel particles, (d) moving the fuel particles away from the separated liquid phase, and washing the particles. Typically the separated liquid phase is regenerated by removing any impurities therefrom and is recycled as the liquid aqueous solution in the continuous process.

In typical embodiments of the invention the ratio of (a) to the fuel is about 0.10 to 0.35 by weight, the ratio of (b) to the fuel is about 0.08 to 0.20 by weight, and the ratio of water to fuel is about 2 to 5 by weight. The solution typically comprises essentially sodium hydroxide and calcium hydroxide or carbonate, and may comprise also magnesium hydroxide or carbonate. The mixture typically is maintained at a temperature of about 175° to 300° C.

DRAWINGS

FIGS. 1 and 2 are flow diagrams illustrating typical steps in practicing the present invention.

FIGS. 3 and 4 are graphs showing some significant and unexpected advantages of the invention.

DEFINITIONS

Figure 5:
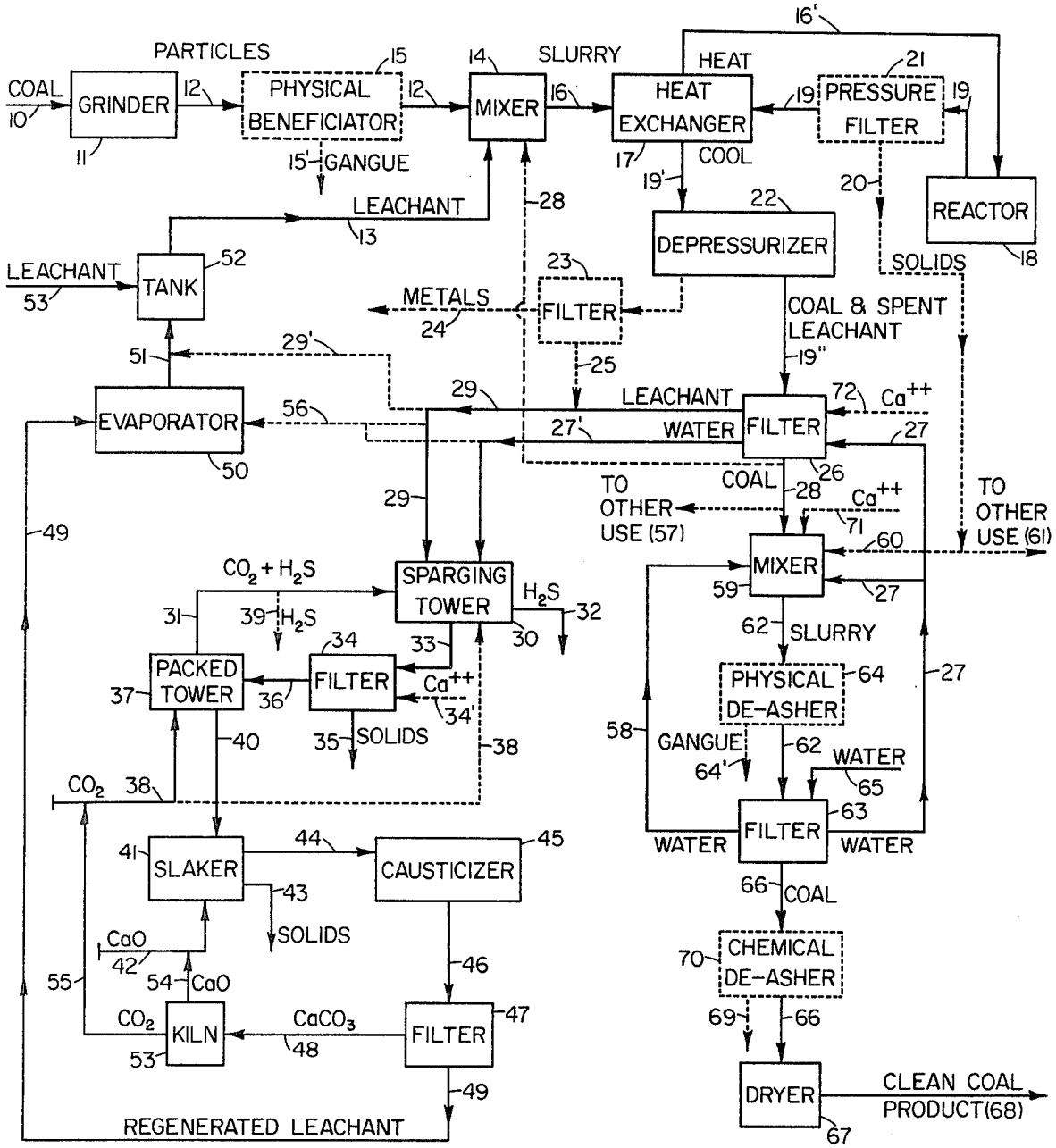
FIG. 5 is a flow diagram illustrating in detail typical apparatus and steps employed in practicing the invention.

Ash—inorganic portion of coal, for example, the oxides of sodium, silicon, iron, and calcium. The metallic values such as iron, may be present as sulfides, sulfates and carbonates or combination of these compounds.

Claus Process—process for converting $H_2S$ to elemental sulfur.

Filtering—separation of a liquid from a solid by a physical method such as passing the liquid through a porous medium while retaining the solid on the medium. As used herein, filtering may include augmentation by other means such as settling, centrifugation, coascervation, and the application of filter aids.

Froth Flotation—separation of two or more compounds whereby one is removed in the foam formed on the surface of a liquidus slurry.

HTP—hydrothermal treatment process; i.e., the present invention.

HTT—(noun) same as HTP; (adjective) hydrothermally treated according to the present invention.

Lime-Carbonate-Process—process which entails treatment of an aqueous alkaline sulfide solution with first $CO_2$ and then lime to regenerate the alkaline values whereby the alkaline values are converted to the corresponding hydroxide, the sulfur is removed as hydrogen sulfide and the resulting calcium carbonate may be regenerated for reuse in the process.

LPG—liquefied petroleum gas.

MAF—moisture ash free.

Martinka Coal—coal from Martinka No. 1 Mine in West Virginia.

Montour Coal—coal from Montour No. 4 Mine in Pennsylvania.

Packed Tower—a cylindrical container loosely packed with a solid material in a vertical position.

Physical Benefication—physical separation of two or more components from a mixture with the objective being to upgrade one component, for example, separation of ash from coal.

SNG—synthesis gas, or synthetic natural gas.

Stretford Process—process for converting $H_2S$ to elemental sulfur.

Westland Coal—Coal from Westland Mine in Pennsylvania.

Fine particles of fuel—typically 70% of the particles smaller than 4 mesh (Tyler Standard).

Washing—a process wherein the water soluble impurities in hydrothermally treated coal are dissolved in water so that they can be removed later by filtration.

DESCRIPTION OF PREFERRED EMBODIMENTS

According to the present invention, fine particles of solid carbonaceous fuel, such as coal of coke, are mixed with a liquid aqueous solution comprising essentially sodium, potassium, or lighium hydroxide together with calcium, magnesium, or barium hydroxide or carbonate, or a plurality thereof, and the mixture is reacted by heating in a closed reactor, for example, an autoclave, under conditions of elevated temperature and pressure.

It should be noted that typically the elevated pressure is merely that pressure, greater than atmospheric pressure (typically greater than 25 psig), which is developed in the closed reactor by the generated steam, or any other evolved or optionally added gases. The reacted mixture is then cooled to about 100° C or lower, and the reacted fuel particles may optionally be washed, dried, separated from the reacted solution by filtration, or any combination of these. See FIGS. 1, 2, and 5 for example. The above sequence of process steps may properly be termed hydrothermal treatment.

During the hydrothermal treatment a significant amount of gasification catalyst (normally 1 to 3 wt. percent of calcium or magnesium) chemically binds to the functional groups of the fuel particles, while a controlled quantity of catalyst is physically incorporated in the fuel particles. Since the hydrothermal treatment opens up the structure of the fuel particles, both the chemically incorporated and the physically incorporated portion of the catalyst effectively penetrate the entire volume of the fuel particles. As a result of the incorporation of a gasification catalyst into the fuel particles and the opening of the fuel particles' structure the gasification reactivity of hydrothermally treated coal is greatly increased.

If the hydrothermally treated fuel particles are to be gasified they will generally first be fed to a hydrogasifier, which, since the coal is non-swelling and non-caking, can be a simple fluid bed. Carbonaceous char from the hydrogasifier, which still will contain most of the akali, is then gasified with steam and oxygen to produce synthesis gas which then is converted to hydrogen using available gas purification technology.

During hydrothermal treatment according to the present invention, another reaction taking place during the heating of the mixture, in addition to the impregnation of the coal with a catalyst, is the solubilization of the sulfur and ash constituents of the fuel particles. That is, the aqueous alkaline solution acts as a leachant. By filtering off the spent leachant solution after cooling, low-sulfur, low-ash fuel particles will remain which, after washing, if desired, and drying, can be either gasified or burned directly. Additionally, the reacted liquid phase i.e., the spent leachant, may be reused as is at least once and/or it may be regenerated by removing the leached out impurities.

The present method may be carried out either in a batchwise fashion or in a substantially continuous operation. Where the extraction is to be substantially continuous, the method typically comprises the steps of continuously introducing the solid fuel at a preselected rate into the liquid aqueous solution to form a slurry, moving the slurry through a region maintained at an elevated pressure and temperature to impregnate the catalyst and leach out the sulfur compounds and ash, moving the slurry outside the reaction region and, if desired, separating the easily removable leached out materials from the solid particles, moving said particles away from the separated leached out material, and, if desired, washing said particles.

FIG. 5 is a flow diagram illustrating typical apparatus and steps employed to produce, on a continous basis, low-sulfur and low-ash coal and coal having an increased gasification reactivity, while simultaneously regenerating the spent leachant. According to this diagram, raw coal 10, either washed or untreated, is passed into a grinder 11 which may be any suitable known device for reducing solid matter to a finely divided state. The finely divided coal particles 12 and the leachant solution 13, as described above, are passed into a mixer 14 where they are mixed. (If low-ash, as well as low-sulfur product coal is desired, before passing into the mixer 14 the finely divided coal particles 12 may optionally be passed through a physical beneficiator 15 where their ash and pyritic sulfur contents are reduced, with the resulting gangue being removed via a stream 15'.)

From the mixer 14 the coal-leachant slurry 16 is passed through the heating zone of a heat exchanger 17 to increase its temperature. The heated slurry 16' is then passed into a high-pressure, high-temperature reactor 18 where the leaching reaction takes place. A stream 19 containing a solid phase consisting essentially of low-sulfur coal particles, and a liquid phase consisting essentially of an aqueous solution of dissolved organic matter, sodium-sulfur species, and unused leachant is passed through the cooling zone of the heat exchanger 17 to lower its temperature. (If a low-sodium and low-ash, as well as low-sulfur product coal 20 is desired, then before passing into the heat exchanger 17 the stream 19 may optionally be passed through a pressure filter 21, with the remaining liquid phase then passing through the heat exchanger 17, a depressurizer 22, and then into a filter 23 where the precipitated metal values 24 are removed and the spent leachant 25 is added to a stream 29.)

From the heat exchanger 17 the cooled stream 19' is passed into the depressurizer 22 and then is passed as a stream 19'' into a filter 26 where the solid and liquid phases are separated. The solid phase i.e., the coal particles, retained in the filter 26 is washed with a process water stream 27 and then discharged from the filter 26 as a stream 28. (Where so desired, the coal stream 28 may optionally be passed back into the mixer 14 where a different leachant solution 13 may be added, and subsequent steps repeated.) The liquid is discharged from the filter 26 as a stream 29 comprising mostly spent leachant, and a stream 27' comprising mostly wash water.

The streams 29 and 27' are passed into a sparging tower 30, and a gas stream 31 containing carbon dioxide and hydrogen sulfide, discussed below, is passed counter-currently through the sparging tower 30 so as to partially carbonate the spent leachant therein to form sodium carbonate. Hydrogen sulfide gas is removed via a gas stream 32 and may be converted to elemental sulfur by an of a number of well known conversion processes. The partially carbonated spent leachant solution 33 is then passed through a filter 34, with the solid organic matter 35 being separated out. (As indicated at 34', calcium ions may be added to the filter 34 to increase the rate of filtration). The spent leachant solution 36 is passed from the filter 34 into a packed tower 37 where a gas stream 38 containing carbon dioxide is passed through counter-currently so that any remaining spent leachant is carbonated. (The gas stream 38 may also be passed to the sparging tower 30 in addition to or instead of the stream 31.) Hydrogen sulfide and carbon dioxide are passed from the packed tower 37 via the gas stream 31, and at least part of the hydrogen sulfide may be removed from the stream 31 via a gas stream 39 and converted to elemental sulfur by any known process.

The carbonated leachant, solution 40, comprising mostly sodium carbonate, is then passed from the packed tower 37 to a slaker unit 41 where calcium oxide 42 is mixed with it. After the large solids have been removed via a stream 43, the carbonated leachant solution 44 is passed into a causticizer 45 where leachant regeneration, i.e., conversion of sodium carbonate to sodium hydroxide, takes place. The slurry 46 of sodium hydroxide solution and calcium carbonate is passed to a filter 47 where the solid calcium carbonate 48 is separated from the regenerated sodium hydroxide (leachant) solution 49. The leachant 49 is passed from the filter 47 to an evaporator 50 where it is concentrated, and the concentrated regenerated leachant stream 51 is passed from the evaporator 50 to a storage tank 52. New leachant is also added to the storage tank 52 via a stream 53 and the combined new and regenerated leachant is conveyed as the stream 13 to the mixer 14.

The calcium carbonate 48 from the filter 47 is passed to a kiln 53 where, as a result of heating, it is converted to calcium oxide 54 and carbon dioxide 55, with the former being mixed with the calcium oxide stream 42 and the latter being mixed with the carbon dioxide stream 38. (Some of the spent leachant stream 29 and the water stream 27' may be taken directly via a stream 56 to the evaporator 50, and some of the leachant stream 29 by itself may be taken directly via a stream 29' to the tank 52 without the need for regeneration.)

Coal particles 28 may be taken directly from the filter 26 to a utilization point 57 or may be reslurried with the process water streams 27 and 58 in a mixer 59. (Some or all of the product coal 20 may, instead of being taken directly to a utilization point 61, be added to the mixer 59 via a stream 60.) The coal-water slurry may then be taken directly to the utilization point 61 or it may be passed, as indicated at 62, into a filter 63. (If a low-ash, as well as a low-sulfur, product coal is desired, then before passing into the filter 63 the slurry 62 may optionally be passed through a physical de-asher 64, the resulting gangue being removed via a stream 64'.) The liquid phase of the slurry (i.e., the water) is discharged from the filter via the stream 27 which is supplied to the filter 26 and the mixer 59 as described above. The solid phase of the slurry (i.e., the coal) retained in the filter 63 is washed with a water stream 65 and the wash water is discharged as the stream 58. The separated coal particles 66 may then be passed to a dryer 67 if a low moisture product coal 68 is desired. (If a low-ash and low-sodium, as well as low-sulfur, product coal is desired, then before or as an alternative (69) to passing into the dryer 67, the coal particles 66 may optionally be passed through a chemical de-asher 70.)

Tables A and B present data establishing the remarkable effect our hydrothermal process has on both the gasification reactivity and the sulfur content of raw coal. Table A gives the conditions under which the various coal samples were hydrothermally treated, e.g., NaOH to coal ratio, temperature, etc., and gives the product analysis for each of the samples, e.g., sulfur content, etc. Table B presents the data obtained when these various coal samples were gasified. The rate of coal gasification was determined by monitoring the weight of the coal as a function of time. The weight vs time data was converted into fractional conversion vs time data for the purpose of comparison of reactivities of various samples to various gases.

TABLE A

SUMMARY OF DATA ON COAL SAMPLES FOR GASIFICATION

| Sample No. | Raw Coal No. | Hydrothermal Treatment: Leachant Composition, by weight: NaOH/Coal | $Na_2CO_3$/Coal | CaO/Coal | Water/Coal | Temp., °C | Time of Leaching, min. | Flow-sheet | Analysis of Coal (as-received basis), percent: Moisture | Ash | Sodium | Calcium | Total Sulfur |
|---|---|---|---|---|---|---|---|---|---|---|---|---|---|
| Montour #1[d] | Montour #1 | Raw Coal; Montour Mine; Batch I; 70% −200 mesh size | | | | | | | 1.10 | 8.34 | 0.02 | — | 2.31 |
| 31310-95A[d] | 31310-95A | Raw Coal; Montour Mine; Batch II; 70% −200 mesh size | | | | | | | 0.5 | 9.2 | 0.03 | — | 2.36 |
| 31464-65E[d] | 31464-65E | Raw Coal; Montour Mine; Batch IV; −150 +200 mesh size | | | | | | | 1.02 | 10.2 | — | — | 2.93 |
| 31212-64C | Montour #1 | 0.161 | 0 | 0 | 1.85 | 250 | 60 | I | 0 | 9.9 | 2.56 | — | 1.08 |
| 31310-64C | 31310-95A | 0.168 | 0 | 0 | 4.00 | 250 | 60 | I | 1.13 | 10.4 | 2.11 | <0.01[a] | 1.05 |
| 31436-65-4 | 31310-95A | 0 | — | 0 | — | — | — | — | <0.1 | 10.0 | 2.26[a] | <0.01[a] | 1.10 |
| 31310-97C$_2$ | 31310-95A | 0.179 | 0 | 0.130 | 2.83 | 250 | 90 | I[b] | 3.03 | 18.6 | 0.13 | 7.5[a] | 0.95 |
| 31529-21C | 31464-65E | 0.500 | 0 | 0 | 3.63 | 250 | 180 | II | 3.19 | 19.4 | 7.18 | — | 1.09 |
| 31310-85C | 31310-95A | 0 | 0 | 0 | 2.40 | 300 | 45 | — | 2.66 | 8.74 | 0.01 | <0.01[a] | 2.34 |
| 31464-13C(2) | Montour #1 | 0.161 | 0 | 0.033 | 2.52 | 250 | 60 | I | 0 | 11.0 | 1.25 | 2.25 | 1.17 |
| 31464-2C | Montour #1 | 0.161 | 0 | 0.130 | 2.52 | 250 | 60 | I | <0.1 | 16.9 | 0.30 | 7.5 | 1.16 |
| 31464-67 | 31310-95A | 0 | 0 | 0.042 | 1.75 | 250 | 60 | II | 0[a] | 13.4[c] | 0.03[c] | 3.0[c] | 2.36[c] |
| 31464-68 | 31310-95A | 0 | 0 | 0.098 | 1.75 | 250 | 60 | III | 0[a] | 19.0[c] | 0.03[c] | 7.0[c] | 2.36[c] |
| 31464-72 | 31310-95A | 0.087 | 0 | 0 | 1.75 | 250 | 60 | IV | <0.01 | 17.8[a] | 5.0[c] | — | 1.69 |
| 31464-77 | 31310-95A | 0.040 | 0 | 0.100 | 1.90 | 250 | 60 | I | — | 19.0[a] | — | 7.0[a] | — |

[a]Estimated
[b]The spent leachant was removed by filtration at the temperature and pressure of hydrothermal treatment.
[c]From material balance.
[d]These coals were not hydrothermally treated.
— Not determined.

TABLE B

SUMMARY OF DATA ON COAL GASIFICATION AT 500 PSIG

| Experiment No. | Sample No.[a] | Gasifying Agent[b] | Gasification Temp., °C | Time for a Given Fractional Conversion (ash-free basis), X, in minutes | | | | | | Final Conversion, X | Final Char Observations | | | |
|---|---|---|---|---|---|---|---|---|---|---|---|---|---|---|
| | | | | X=0.4 | X=0.5 | X=0.6 | X=0.7 | X=0.8 | X=0.9 | | Change in the Shape of the Coal Pellets[c] | Tendency For Swelling of Coal[d] | Extent of Char (ash) Fusion[e] | Final Volume of Char Compared to the Initial Volume of Sample[f] |
| 31509-11 | 31212-64C | Hydrogen | 825 | 0.3 | 4.7 | 17.7 | 37 | 74 | — | 0.87 | None | None | None | Much Less |
| 31509-18 | Montour #1 | Hydrogen | 825 | 2.5 | 22.5 | 69.5 | 139 | 224 | — | 0.85 | Extreme | Very High | Large | Slightly Less. |
| 31509-20 | 31310-64C | Carbon dioxide | 825 | 4 | 8.3 | 12.7 | 17 | 23.8 | 34.5 | 0.95 | Extreme | Small | Medium | Less |
| 31509-23 | 31310-64C | Hydrogen | 825 | 0.7 | 8 | 30.5 | 70.5 | 137 | — | 0.82 | Substantial | Small | Medium | Less |
| 31509-25 | 31436-65-4 | Hydrogen | 825 | 1 | 8 | 26 | 55 | 104 | — | 0.87 | Extreme | Small | Large | Less |
| 31509-27 | 31310-95A | Hydrogen | 825 | 0.75 | 7 | 38 | 91 | 187 | — | 0.84 | Extreme | Very High | Large | Slightly Less |
| 31509-29 | 31310-97$C_2$ | Hydrogen | 825 | 0.25 | 0.65 | 1.55 | 2.7 | 5 | — | 0.85 | None | None | None | Much Less |
| 31509-30 | 31310-97$C_2$ | Carbon dioxide | 775 | 3.2 | 14 | 30.5 | 50 | 75 | 115 | 0.91 | Small | None | Small | Less |
| 31509-32 | 31529-21C | Hydrogen | 825 | 0.3 | 1.05 | 4.7 | 11 | 16.5 | 20 | 1.00 | Substantial | None | Large | Much Less |
| 31509-34 | 31529-21C | Hydrogen | 825 | 0.35 | 1.7 | 5.9 | 12 | 16.5 | 19.5 | 1.00 | Extreme | None | Large | Much Less |
| 31509-35 | 31529-21C | Carbon dioxide | 825 | 6 | 12 | 22 | 37 | 58 | — | 0.83 | Extreme | None | Large | Much Less |
| 31509-37 | 31310-85C | Hydrogen | 825 | 0.8 | 11 | 44 | 94 | — | — | 0.73 | Extreme | Very High | Large | More |
| 31509-38 | 31464-13C(2) | Hydrogen | 825 | 0.5 | 8.5 | 30 | 65 | — | — | 0.75 | Small | Small | Small | Less |
| 31509-39 | 31464-2C | Hydrogen | 825 | 0.15 | 0.8 | 1.9 | 3.5 | — | — | 0.78 | None | None | None | Less |
| 31509-40 | 31464-67 | Hydrogen | 825 | 0.4 | 8 | 43 | — | — | — | 0.68 | Extreme | High | Large | Slightly Less |
| 31509-41 | 31464-68 | Hydrogen | 825 | 0.3 | 7.2 | 34 | — | — | — | 0.66 | Substantial | Medium | Medium | Less |
| 31509-42 | 31310-97$C_2$ | Steam | 825 | 0.4 | 1.6 | 3.5 | 6 | 9 | 13.4 | 0.92 | None | None | None | Much Less |
| 31509-43 | 31310-95A | Steam | 825 | 3.5 | 10.5 | 19.5 | 30 | 44.5 | 61 | 0.91 | Extreme | High | Large | Less |
| 31509-44 | 31464-72 | Steam | 825 | 0.65 | 1.9 | 3.6 | 5.55 | 7.8 | 10.6 | 1.00 | Extreme | None | Large | Much Less |
| 31509-45 | 31464-77 | Steam | 825 | 0.8 | 2.15 | 4.1 | 6.7 | 9.5 | 14 | 0.96 | Small | Small or None | Small | Less |
| 31509-46 | 31529-23$C_2$ | Steam | 725 | 3.8 | 10 | 17.5 | 26 | 36 | — | 0.82 | Small | Small or None | Medium | Less |
| 31509-47 -A[g] | 31310-97$C_2$ | Hydrogen | 825 | 0.15 | 0.55 | — | — | — | — | 0.53 | — | — | — | — |
| 31509-47 -B[g] | 31509-47A | Steam | 825 | — | — | 1.4 | 3.4 | 6 | 9.3 | 0.99 | None | None | None | Much Less |

[a] The samples, data on which is given in Table 1, were formed into 3/16-in. dia. × 1/16-in. long cylindrical pallets without using any binder.
[b] While using hydrogen, the flow rates of hydrogen and helium were 12 SCFH and 4 SCFH, respectively. In case of carbon dioxide, the flow rates of carbon dioxide and helium were 10 SCFH and 4 SCFH, respectively. Finally, with steam, the flow rates of steam and helium were 0.66 lb/hr and 20 SCFH, respectively.
[c] The order is: None, Small, Substantial, Extreme.
[d] The order is: None, Small, Medium, High, Very High.
[e] The order is: None, Small, Medium, Large.
[f] The order is: Much Less, Less, Slightly Less, More
[g] After a fractional conversion of 0.53 with hydrogen, achieved in 1 minute, the sample was gasified with steam.

The fractional conversion of coal on an ash-free basis is defined as $$X = 1 - \frac{\text{weight of coal at any time t - weight of the ash}}{\text{weight of coal initially - weight of the ash}}$$

and, the rate of gasification at time $t$ can be defined as rate $= dx/dt$.

The data in Table B compare the times required for gasification of various samples in order to achieve specified values of fractional conversion. For all the samples, the rate of gasification is high in the initial stages of gasification (up to approx. 0.4) followed by a relatively low rate that ultimately diminishes to zero as the carbon content in the charge is gasified. The data in Table B illustrate the following:

(1) The hydrothermally treated coals are more reactive, to hydrogen, $CO_2$, and steam, then raw coal. The rate of gasification at 500 psig and at a given X depends on (a) the procedure of hydrothermal treatment, (b) the type of catalyst, (c) the concentration of catalyst, (d) the gasification agent ($H_2$, $CO_2$ or steam), and (e) the temperature of gasification.

(2) By proper hydrothermal treatment of coal, the time required for 80 percent conversion of coal at 825° C can be lowered by a factor of 35 for hydrogen (compare experiment No. 31509-29 with No. 31509-27) and by a factor of 6 for steam (compare No. 31509-43 with No. 31509-42).

(3) The data for experiment No. 31509-47 (A and B) show that gasification by hydrogen to about 50 percent conversion speeds up the subsequent steam gasification rate (compare No. 31509-47-B with No. 31509-42).

(4) By proper hydrothermal treatment of coal, good steam gasification rates can be achieved at temperatures less than about 825° C (compare No. 31509-46 with No. 31509-43).

(5) A sample that was hydrothermally treated with NaOH + $Ca(OH)_2$ and was washed to remove sodium compounds showed a very high reactivity toward hydrogen (experiment No. 31509-29). However, the sample treated with $Ca(OH)_2$ alone (experiment No. 31509-41) was nearly as unreactive as raw coal (experiment No. 31509-27). It appears that NaOH opens up the structure of coal, allowing the catalyst to penetrate the coal, but $Ca(OH)_2$ does not.

(6) The tendency for swelling of coal during gasification is lowered by hydrothermal treatment. This reduction in the tendency for swelling (caking) depends on the procedure for hydrothermal treatment, type of catalyst, and the amount of catalyst. In general, the increased reactivity of coal (compared to raw, untreated coal) is accompanied by decreased tendency for swelling. By proper hydrothermal treatment, a highly caked coal can be rendered totally non-caking.

The sulfur content of hydrothermally treated coal depends on the conditions of hydrothermal treatment and any further treatment, such as washing, filtration, etc. Moreover, a substantial amount of the sulfur present in HTT coal may not be released to the atmosphere during the combustion or the gasification of coal because of the presence of calcium and other alkali metal compounds, introduced into the coal during hydrothermal treatment, which react with the sulfur during coal combustion or gasification.

Table C represents experimental data confirming the unexpectedly high increase in the gasification reactivity of raw coal treated according to the present invention. The hydrothermal process variables studied were: (1) NaOH to coal ratio, (2) CaO to coal ratio, (3) water to coal ratio, (4) temperature at which the hydrothermal treatment reaction is carried out, and (5) type of coal treated. It should be noted here that there are only two independent variables among the NaOH to coal ratio, the water to coal ratio, and the NaOH concentration, with the NaOH concentration being determinable once the NaOH to coal ratio and the water to coal ratio are known.

TABLE C

DATA ON THE EFFECT OF PROCESS VARIABLES FOR HYDROTHERMAL TREATMENT USING FLOWSHEET I ON THE REACTIVITY AND CAKING TENDENCY OF HTT COAL

| Variable | Experiment Number | Sample of Raw Coal Used[a] | Leachant Composition, by weight: NaOH/Coal | NaOH Conc., wt % | CaO/Coal | Water/Coal | Temperature for Leaching, C | Time of Leaching, min | Temperature[b] for Gasification | Relative Reactivity, $R_x$: For X=0.6 | X=0.7 | Final Char Observation: Tendency for Swelling and Caking of Coal[c] | Extent of Char (ash) Fusion[d] |
|---|---|---|---|---|---|---|---|---|---|---|---|---|---|
| CaO to coal ratio | 31509-23 | II | 0.168 | 4.0 | 0 | 4.0 | 250 | 60 | 825 | 1.51 | 1.56 | Small | Medium |
| | -38 | I | 0.161 | 6.0 | 0.033 | 2.5 | 250 | 60 | 825 | 2.3 | 2.1 | Small | Small |
| | -39 | I | 0.161 | 6.0 | 0.130 | 2.5 | 250 | 60 | 825 | 36.6 | 39.7 | None | None |
| | -29[b] | II | 0.179 | 6.0 | 0.130 | 2.8 | 250 | 90 | 825 | 31.7 | 42.3 | None | None |
| | -90[b] | II | 0.179 | 6.0 | 0.130 | 2.8 | 250 | 90 | 850 | 14.2 | 23.6 | None | None |
| | 31793-8 | III | 0.161 | 3.9 | 0.30 | 4.0 | 250 | 120 | 850 | 11.8 | 7.3 | None | None |
| | -31 | III | 0.161 | 6.0 | 0.20 | 2.5 | 250 | 120 | 850 | 21.2 | 11.3 | None | None |
| | -33 | III | 0.16 | 6.0 | 0.08 | 2.5 | 250 | 120 | 850 | 1.49 | 1.52 | Small | Medium |
| NaOH to coal ratio | 31509-41 | II | 0 | 0 | 0.10 | 1.8 | 250 | 60 | 825 | 1.15 | — | Medium | Medium |
| | 31793-17 | III | 0.04 | 1.6 | 0.13 | 2.5 | 250 | 60 | 850 | 0.96 | 1.13 | None | Medium |
| | -12 | III | 0.08 | 2.0 | 0.1 | 4.0 | 250 | 60 | 850 | 1.70 | 1.58 | None | Small |
| | 31509-90 | II | 0.179 | 6.0 | 0.130 | 2.8 | 250 | 90 | 850 | 14.2 | 23.6 | None | None |
| | 31793-15 | II | 0.35 | 8.0 | 0.1 | 4.0 | 250 | 120 | 850 | 11.3 | 20.9 | None | None |
| | -28 | III | 0.70 | 14.9 | 0.1 | 4.0 | 250 | 120 | 850 | 17.9 | 7.5 | None | None |
| | -34 | III | 0.12 | 4 | 0.1 | 1.88 | 250 | 120 | 850 | 23.6 | 27.9 | None | None |
| | -37 | III | 0.161 | 6 | 0.1 | 2.51 | 250 | 120 | 850 | 26.0 | 36.4 | None | None |
| | -36 | III | 0.08 | 2 | 0.1 | 1.92 | 250 | 120 | 850 | 5.47 | 2.22 | None | None |
| Temperature of Leaching | 31793-9 | III | 0.35 | 8.0 | 0.1 | 4.0 | 150 | 120 | 850 | 1.20 | 1.00 | None or small | Large |
| | 31509-59 | II | 0.16 | 6.0 | 0.13 | 2.5 | 200 | 60 | 825 | 24.2 | 27.5 | None | None |
| | -60 | II | 0.16 | 6.0 | 0.13 | 2.5 | 225 | 60 | 825 | 25.5 | 36.7 | None | None |
| | -29[b] | II | 0.179 | 6.0 | 0.13 | 2.8 | 250 | 90 | 825 | 31.7 | 42.3 | None | None |
| | -90[b] | II | 0.179 | 6.0 | 0.13 | 2.8 | 250 | 90 | 850 | 14.2 | 23.6 | None | None |
| | 31793-27 | II | 0.35 | 8.0 | 0.10 | 4.0 | 300 | 120 | 850 | 0.83 | 1.37 | None or small | Large |
| | -11 | II | 0.35 | 8.0 | 0.13 | 4.0 | 350 | 120 | 850 | 0.79 | 1.23 | None or small | Large |
| | -32 | III | 0.161 | 6.0 | 0.13 | 2.5 | 175 | 120 | 850 | 1.49 | 1.35 | Small | Medium |
| Type of coal | 31509-90 | Montour (II) | 0.179 | 8.0 | 0.13 | 2.8 | 250 | 90 | 850 | 14.2 | 23.6 | None | None |
| | -26 | Westland[e] | 0.3 | 7.0 | 0.13 | 4.0 | 250 | 120 | 850 | 37.0 | 42.6 | None | None |
| | -6 | Martinka[f] | 0.3 | 7.0 | 0.13 | 4.0 | 250 | 120 | 850 | 1.69 | 1.63 | Small | Medium |
| | -29 | Westland[e] | 0.30 | 7.0 | 0.13 | 4.0 | 250 | 120 | 850 | 37.0 | 42.6 | None | None |
| | -35 | Martinka[f] | 0.35 | 8.0 | 0.13 | 4.0 | 350 | 120 | 850 | 2.81 | 3.15 | Medium | Medium |

[a]Samples II and III were quite similar to each other and were from Batch II of Montour mine coal. Sample I was from Batch I of Montour mine coal.
[b]The relative reactivity decreased with an increase in the temperature of gasification from 825 C to 850 C.
[c]The order is: none, small, medium, high, very high. The raw coal is characterized by "very high".
[d]The order is: none, small, medium, large. The raw coal is characterized by "large".
[e]This coal is from Pittsburgh seam —8,
[f]This coal is from Lower Kittaning.
—Not determined.

The data in Table C support the following observations:

(1) when the amount of CaO used in the hydrothermal treatment of coal is varied, the gasification reactivity of the coal is drastically increased within the range of CaO to coal ratio of from 0.08 to 0.20, and there is at least some increase in reactivity within the broader range of from 0.02 to 0.30;

(2) when the amount of NaOH used in the hydrothermal treatment of coal is varied, the gasification reactivity of the coal is drastically increased within the range of NaOH to coal ratio of from 0.1 to 0.35, and there is at least some increase in reactivity within the broader range of from 0.04 to 0.70;

(3) for the water to coal ratio the preferred range is from about 2 to 5 and the broad range is from about 1 to 10;

(4) when the temperature at which the hydrothermal treatment takes place is varied, the gasification reactivity of the coal is drastically increased within the range of from 175° to 300° C, and there is at least some increase within the broader range of from 150° C to 350° C; and (5) while the greatest increase in reactivity was observed in coal from Pittsburgh Seam 8 or similar (medium or high sulfur and highly caking), medium-volatile bituminous coal, there was at least some increase observed in all of the coals tested.

Concerning observations 1 and 2 above, economic considerations probably limit the upper limit of the preferred range of CaO to coal ratio to 0.15, and probably limit the upper limit of the preferred range of NaOH to coal ratio to 0.35. Concerning observation 3 above, while our laboratory equipment did not permit us to exceed 350° C, it is believed that at least some increase in reactivity will be achieved up to the critical point of water, 375° C.

Additionally, the observed increase in gasification reactivity indicates that hydrothermal treatment according to the present invention should produce a coal having improved liquefaction feedstock properties.

FIGS. 3 and 4 provide a comparison, based on our experimental data, of the hydrogasification and steam gasification reactivity respectively of coal hydrothermally treated according to the present invention versus raw coal and versus coal treated by soaking in an aqueous CaO solution at room temperature for 30 minutes and then drying the slurry. Of the two conventional methods for impregnation of coal with a catalyst discussed above, soaking is thought to be the more effective method. FIGS. 3 and 4 show the remarkable increase in the reactivity of hydrothermally treated coal compared to the conventional treatment of coal with the same amount of the calcium catalyst.

Table D provides data comparing the relative reactivities of coal treated with different catalyst systems. The most reactive coal was produced when an aqueous solution of NaOH and CaO was used in hydrothermal treatment.

TABLE D

EFFECTIVENESS OF VARIOUS CATALYSTS FOR HYDROGASIFICATION AT 500 PSIG

| Sample[a] of Raw Coal Used | Flowsheet Used | Leachant (Catalyst) Used | Leachant Composition, by weight | Temperature for Leaching C | Time of Leaching min | Metallic Content of Catalyst 0.10, HTT Coal, wt % Sodium | Metallic Content of Catalyst 0.10, HTT Coal, wt % Calcium | Temperature[b] for Gasification, C | Relative Reactivity of HTT Coal, $R_x$ For X = 0.6 | Relative Reactivity of HTT Coal, $R_x$ For X = 0.7 | Final Char Observation: Tendency for Swelling and Caking of Coal[c] | Final Char Observation: Extent of Char[d] (ash) Fusion |
|---|---|---|---|---|---|---|---|---|---|---|---|---|
| II | I | NaOH | NaOH/coal = 0.168, water/coal = 4.0 | 250 | 60 | 2.11 | 0 | 825 | 1.51 | 1.56 | Small | Medium |
| II | I or II | CaO | CaO/coal = 0.10, water/coal = 1.8 | 250 | 60 | 0 | 6.38 | 825 | 1.15 | — | Medium | Medium |
| II | I | NaOH + CaO | NaOH/coal = 0.179, CaO/coal = 0.13, water/coal = 2.8 | 250 | 90 | 0.13 | 7.5 | 825 | 31.7 | 42.3 | None | None |
| II | I | NaOH + CaO | Same HTT coal as above | 250 | 90 | 0.13 | 7.5 | 850 | 14.2 | 23.6 | None | None |
| III | I or II | CaO | CaO/coal = 0.10 water/coal = 1.8 | 25 | 30 | 0 | 6.38 | 850 | 2.17 | 2.50 | Small or medium | Large |
| II | I | Water | Water/coal = 2.4 | 300 | 45 | 0 | 0 | 825 | 1.05 | 1.17 | Very high | Large |
| II | I | Water + oxygen | Water/coal = 5.0, oxygen pressure = 160 psig | 125 | 90 | 0 | 0 | 825 | 0.74 | — | None or small | Medium |
| II | I | KOH + MgO | KOH/coal = 0.3, MgO/coal = 0.1, water/coal = 4.0 | 250 | 120 | 0 (K and Mg not analyzed for) | 0 | 850 | 7.65 | 3.68 | None | Small |
| II | II | NaOH + CaO | NaOH/coal = 0.02, CaO/coal = 0.1, water/coal = 2 | 250 | 60 | 1.0 | 6.4 | 825 | 1.96 | 2.16 | None or small | Medium |
| II | II | NaOH + $CaCO_3$ | NaOH/coal = 0.4, $CaCO_3$/coal = 0.18, water/coal = 3 | 250 | 60 | 1.9 | 6.0 | 825 | 4.18 | 4.23 | None or small | Medium |

[a]Both samples II and III were from Batch II of Montour mine coal ground at different times and were quite similar to each other.
[b]The relative reactivity decreased with an increase in the temperature of gasification from 825 C to 850 C.
[c]The order is: none, small, medium, high, very high. The raw coal is characterized by "very high".
[d]The order is: none, small, medium, large. The raw coal is characterized by "large".
—Not determined.

It is clearly demonstrated by the data that treatment with CaO alone or with NaOH alone, as long as the sodium content of HTT coal is around 2 percent, is not effective in making the coal very reactive. However, treatment with NaOH and CaO makes the coal more than one order of magnitude more reactive than the treatment with NaOH or CaO alone. It should be noted that once a coal has been treated with a leachant containing sufficient quantities of NaOH and CaO, it is not necessary to retain the sodium in coal for maintaining the high reactivity of coal. The data suggest that the role of NaOH is to open up (and alter) the structure of coal and thus allow the CaO to penetrate the coal and to react with it. Furthermore, the data suggest that once the structure of coal has been opened up, calcium (as CaO, $Ca(OH)_2$, or as part of coal) is a better catalyst than sodium (as NaOH or as part of coal).

The data in Table D show that NaOH + CaO + $CaCO_3$, and KOH + MgO are also suitable catalysts. Thus it would appear that mixed leachants of NaOH + $CaCO_3$ and KOH + MgO may be nearly as effective as NaOH + CaO in making the coal very reactive.

Product analysis experiments conducted on coal hydrothermally treated with an aqueous solution of NaOH and CaO according to the present method showed a remarkable decrease in the sulfur, ash, and sodium content of the coal so treated, see Table E. The data in Table E show that considerable sulfur removal is attained within the following ranges of process parameters: (1) temperature: 150° to 350° C (again it is believed that beneficial results are attainable up to the critical point of water, although our equipment would not exceed 350° C); (2) NaOH to coal ratio: 0.04 to 0.70; (3) NaOH concentration: 1.5 to 15 weight percent; (4) CaO to coal ratio: 0.03 to 0.30. The data in Table E also show that sulfur removal is attained with various different coals.

TABLE E

EFFECT OF PROCESS VARIABLES ON DESULFURIZATION OF COAL WITH NaOH + CaO

| Variable | Experiment No.[a] | NaOH to Coal ratio, by wt. | CaO to Coal ratio, by wt. | Water to Coal ratio by wt. | Concentration of NaOH wt % | Temp, C | Percent Sulfur Removal (MAF) at various leaching times: t=10 min. | t=30 min. | t=60 min. | t=90 | t=120 | Final Product: Time of Leaching | Total Sulfur content, wt % (MAF) | Sodium content, wt % (MAF) |
|---|---|---|---|---|---|---|---|---|---|---|---|---|---|---|
| Temperature | 31464- 95 | 0.16 | 0.13 | 2.5 | 6.0 | 200 | — | — | 29.2[b] | — | — | 60[b] | 1.84 | 0.33 |
| | - 96 | 0.16 | 0.13 | 2.5 | 6.0 | 225 | — | — | 37.3[b] | — | — | 60[b] | 1.63 | 0.35 |
| | 31689- 7 | 0.16 | 0.13 | 2.5 | 6.0 | 250 | — | — | 46.2[b] | — | — | 60[b] | 1.40 | 0.85 |
| | - 52 | 0.35 | 0.10 | 4.0 | 8.0 | 150 | — | — | — | — | 17.7 | 120 | 2.14 | 0.38 |
| | - 31 | 0.35 | 0.10 | 4.0 | 8.0 | 250 | 51.9 | 55.5 | — | — | 59.1 | 120 | 1.06 | 0.17 |
| | 31613- 95 | 0.35 | 0.10 | 4.0 | 8.0 | 300 | — | — | — | — | 64.6 | 120[b] | 0.92 | — |
| | - 93 | 0.35 | 0.13 | 4.0 | 8.0 | 350 | — | — | — | — | 78.6[c] | 120[b] | 0.56 | 1.40 |
| | 31310- 97 | 0.179 | 0.13 | 2.8 | 5.95 | 250 | — | — | — | 51.5[d] | — | 90[d] | 1.26 | 0.17 |
| CaO/Coal Ratio | 31464- 13[e] | 0.16 | 0.033 | 2.5 | 6.0 | 250 | — | 42.0 | 46.3[b] | — | — | 60[b] | 137 | 1.46 |
| | - 10[e] | 0.16 | 0.065 | 2.5 | 6.0 | 250 | — | 43.1 | 43.1[b] | — | — | 60[b] | 1.45 | 1.38 |
| | - 2[e] | 0.16 | 0.13 | 2.5 | 6.0 | 250 | — | — | 42.7[b] | — | — | 60[b] | 1.46 | 0.38 |
| | 31689- 33 | 0.16 | 0.10 | 4.0 | 3.85 | 250 | 48.3 | 54.8 | — | — | 56.4 | 120 | 1.13 | 0.30 |
| | - 49 | 0.16 | 0.30 | 4.0 | 3.85 | 250 | 53.5 | 56.9 | — | — | 59.9 | 120 | 1.04 | 0.16 |
| NaOH/Coal Ratio | 31689- 59 | 0.04 | 0.13 | 2.5 | 1.57 | 250 | — | — | 30.0[b] | — | — | 60[b] | 1.82 | 0.67 |
| | - 53 | 0.08 | 0.10 | 4.0 | 1.96 | 250 | 33.8 | 40.2 | — | — | 42.1 | 120 | 1.51 | 0.59 |
| | - 33 | 0.16 | 0.10 | 4.0 | 3.85 | 250 | 48.3 | 54.8 | — | — | 56.4 | 120 | 1.13 | 0.30 |
| | - 31 | 0.35 | 0.10 | 4.0 | 8.0 | 250 | 51.9 | 55.5 | — | — | 59.1 | 120 | 1.06 | 0.17 |
| | - 50 | 0.70 | 0.10 | 4.0 | 14.9 | 250 | 58.4 | 60.0 | — | — | 60.5 | 120 | 1.03 | 0.18 |
| Type of Coal | 31689- 31 | 0.35 | 0.10 | 4.0 | 8.0 | 250 | 51.9 | 55.5 | — | — | 59.1 | 120 | 1.06 | 0.17 |
| | - 48[f] | 0.30 | 0.10 | 4.0 | 6.98 | 250 | — | — | — | — | 53.4 | 120 | 0.97 | 0.22 |
| | - 51[g] | 0.30 | 0.10 | 4.0 | 6.98 | 250 | — | — | — | — | 71.7 | 120 | 0.78 | 1.60 |

[a] All the experiments, except as noted below, were conducted on Batch 2 of Montour #4 coal which had a total sulfur content of 2.60 percent (MAF) and an organic sulfur content of 0.92 percent (MAF).
[b] The product slurry was allowed to cool down slowly before primary filtration (Sample "C") for these samples. The rest of the samples were drawn from the autocalve during experiments.
[c] In this experiment 70 percent organic sulfur and 35 percent coal was extracted on a moisture-ash-free basis. The final product had 54 percent (MAF) less organic sulfur than raw coal.
[d] The sample was first treated with CaO and water at 250 C for one hour and then NaOH was added to the autoclave containing the slurry of coal, water and CaO. The spent leachant was separated from product coal by pressure filtration.
[e] The experiments were performed on Batch 1 of Montour #4 coal which had a total sulfur content of 2.55 percent (MAF) and an organic sulfur content of 1.15 percent (MAF).
[f] The raw coal was from Westland mine and contained 2.08 percent (MAF) total sulfur and 0.82 percent (MAF) organic sulfur.
[g] The raw coal was from Martinka #1 mine and contained 2.76 percent (MAF) total sulfur and 0.49 percent (MAF) organic sulfur.
— Not determined.

Hydrothermal treatment with solutions of mixed oxides or hydroxides of elements in Groups IA and IIA of the periodic table generally result in greater sulfur removal than hydrothermal treatment with NaOH alone, as shown in Table F. The data in Table F show the effectiveness of various mixed solutions consisting of the oxides or hydroxides of Na, K, Li, Ca, Mg, and Ba. In each experiment the time of hydrothermal treatment was sufficient to allow equilibrium (maximum sulfur removal) to be attained. The reaction is estimated to be 90 percent complete in 10 minutes and 95 percent complete in 30 minutes. From this data it can be seen that all the mixed solution systems studied are quite efficient in removing sulfur from coal. The following conclusions can be drawn from the data:

(1) A mixed solution of hydroxides from Group IA alone, such as NaOH + KOH, is not better than NaOH alone (data for Experiment No. 31689-30) for removing the sulfur from coal. Based on earlier experiments with CaO alone, which removed only about 25 percent sulfur, it appears that a mixed solution of hydroxides or oxides from Group IIA alone will be much less efficient than NaOH alone.

(2) When either CaO, MgO, or $Ba(OH)_2$, is used with NaOH, KOH, or LiOH, the percent sulfur removal is increased.

(3) Use of CaO or MgO with NaOH results in a sodium content that is substantially lower than the sodium content of the NaOH-treated product.

(4) MgO is a more effective additive than CaO in extracting sulfur from coal.

TABLE F

EFFECTIVENESS OF VARIOUS MIXED LEACHANTS FOR DESULFURIZATION OF COAL

| Experiment No. | Leachant used: Leachant I | Leachant used: Leachant II | Leachant used: Leachant III | Leachant Composition, by weight: Leachant I/ Coal ratio | Leachant Composition, by weight: Leachant II/ Coal | Leachant Composition, by weight: Leachant III/ Coal | Leachant Composition, by weight: Water/ Coal | Leaching Temp., C | Time of Leaching min. | Analysis of Product (MAF): Sodium Content | Analysis of Product (MAF): Sulfur | Percent Sulfur Extraction (MAF) |
|---|---|---|---|---|---|---|---|---|---|---|---|---|
| Raw Coal: Montour #4 mine, Batch 2; 70 percent −200 mesh | | | | | | | | | | 0.03 | 2.60 | NA |
| 31529-66 | NaOH | NA | NA | 0.40 | NA | NA | 4.0 | 250 | 120[a] | 3.21 | 1.11 | 57.3 |
| 31689-31 | NaOH | CaO | NA | 0.35 | 0.10 | NA | 4.0 | 250 | 120 | 0.17 | 1.06 | 59.1 |
| -45 | NaOH | $Ba(OH)_2$ | NA | 0.30 | 0.30 | NA | 4.0 | 250 | 120[a] | 0.20 | 1.22 | 53.0 |
| -27 | NaOH | MgO | NA | 0.35 | 0.10 | NA | 4.0 | 250 | 120 | 1.65 | 0.95 | 63.4 |
| -30 | NaOH | KOH | NA | 0.30 | 0.30 | NA | 4.0 | 250 | 120 | 1.94 | 1.15 | 55.9 |
| -32 | NaOH | KOH | CaO | 0.30 | 0.20 | 0.10 | 4.0 | 250 | 120 | 0.12 | 1.04 | 60.1 |
| -34 | NaOH | CaO | MgO | 0.30 | 0.10 | 0.10 | 4.0 | 250 | 120 | 0.13 | 1.03 | 60.5 |
| -35 | KOH | CaO | NA | 0.30 | 0.10 | NA | 4.0 | 250 | 120 | 0 | 1.09 | 57.9 |
| -36 | KOH | MgO | NA | 0.30 | 0.10 | NA | 4.0 | 250 | 120 | 0 | 1.05 | 59.7 |
| -46 | KOH | $Ba(OH)_2$ | NA | 0.30 | 0.30 | NA | 4.0 | 250 | 120 | 0 | 1.21 | 53.4 |
| -43 | LiOH | CaO | NA | 0.30 | 0.10 | NA | 4.0 | 250 | 120 | 0 | 0.97 | 62.6 |
| -44 | LiOH | MgO | NA | 0.30 | 0.10 | NA | 4.0 | 250 | 120 | 0 | 0.99 | 62.0 |

[a]The product slurry was allowed to cool down slowly and then filtered (Sample "C"). The other samples were drawn from the autoclave during experiments.
NA Not applicable.
—Not determined.

The use of mixed solutions consisting of NaOH, KOH, or LiOH and CaO, MgO or CaO + MgO results in the following advantages over an aqueous solution of NaOH, KOH, or LiOH alone:

(1) The maximum (equilibrium) percent sulfur removal generally is increased.

(2) The sodium content of HTT coal is lower. It was also found that if KOH or LiOH are used instead of NaOH then the use of mixed solutions will result in the lowering of the potassium or the lithium content of HTT coal. The lowering of the sodium content will result in the reduction of the cost of hydrothermal treatment and in the reduction of corrosion problems in a boiler using HTT coal.

(3) The presence of calcium (or magnesium or barium) in coal can be very beneficial since it will combine with some of the sulfur in coal during the combustion, pyrolysis, or the gasification of coal. Since a substantial amount of the calcium is chemically bound to the HTT coal and since all the calcium is finely distributed in the HTT coal, the efficiency of sulfur absorption to form CaS (MgS) under reducing conditions and to form $CaSO_4$ ($MgSO_4$) under oxidizing conditions is expected to be quite high. Retention of sulfur by the calcium increases the number of high sulfur coals which will meet Federal Sulfur Emission Standards and thus, the applicability of coals as environmentally acceptable solid fuels. It was found that 88 percent of sulfur in coal was retained by the char (ash) of the HTT coal treated with NaOH + CaO after hydrogasification of 85 percent of coal, while only 3 percent sulfur was retained by the char from raw coal.

The increased reactivity of the hydrothermally treated coals is illustrated further in Table G where it is seen that the reactivity of HTT coal at 150 psig is considerably higher than the reactivity of raw coal at 500 psig for hydrogasification. Thus, reasonable hydrogasification rates can be obtained with HTT coal at pressures even lower than 150 psig. On the other hand, pressures exceeding 500 psig are required to obtain reasonable hydrogasification rates with raw coal.

TABLE G

EFFECT OF TEMPERATURE AND PRESSURE OF HYDROGASIFICATION ON THE REACTIVITY AND CAKING TENDENCY OF HTT COAL

| Experiment No.[a] 31509- | Temperature of Gasification, C | Pressure of Gasification, psig | Relative Reactivity, $R_x$[b] | | Final Char Observation | |
|---|---|---|---|---|---|---|
| | | | for X=0.6 | for X=0.7 | Tendency for Swelling and Caking of Coal[c] | Extent of Char (ash) Fusion[d] |
| 90 | 850 | 500 | 14.15 | 23.59 | None | None |
| 92 | 850 | 250 | 8.09 | 14.15 | None | None |
| 94 | 850 | 150 | 6.02 | 10.34 | None | None |
| 96 | 750 | 500 | 1.62 | 0.89 | None | None |
| 97 | 650 | 500 | 0.88 | — | None | None |

[a]The HTT coal was produced by hydrothermal treatment of Montour mine (Sample No. II) coal at 250 C for 90 minutes according to Flowsheet I using an NaOH to coal ratio of 0.179, a CaO to coal ratio of 0.130, and a water to coal ratio of 2.8.

[b]The reactivity of raw coal at 850 C and 500 psig is taken to be equal to one.

[c]The order is: None, Small, Medium, Large, Very large. The raw coal is characterized by "Very large".

[d]The order is: None, Small, Medium, Large. The raw coal is characterized by "Large".

The high reactivity of HTT coal also results in reasonable hydrogasification rates at reduced temperatures. The data in Table G show that the temperature for hydrogasification of HTT coal at about 650° to 750° C is comparable to hydrogasification temperature of 850° C for raw coal. It is the low pressure operation aspect, and not the low temperature operation aspect, for hydrogasification of HTT coal that is of particular importance. Furthermore, the analysis of the gaseous products showed that on lowering the pressure for hydrogasification, the percent of carbon converted to methane, which is the predominant product of reaction, did not change significantly. Thus, an important aspect of the increased hydrogasification reactivity is that high concentrations of methane will be achievable in the raw product gas, thereby reducing the amount of methane that must be produced by methanation.

The data in Table H show that the high reactivity of hydrothermally treated coal permits steam gasification to take place, at reasonable rates, at reduced temperatures. Providing heat for the endothermic steam-carbon reaction is one of the factors that contributes substantially to the cost of SNG from coal. The reason for the costliness of this step is primarily that oxygen is used to combust part of the carbon to provide the heat. Thus, anything that can lower the temperature required for gasifying coal with steam will reduce oxygen requirements and thereby SNG costs. Our catalyst incorporation procedure allows a substantial reduction in the steam gasification temperature over that required for either raw coal steam gasification or coal that contains alkali catalysts that are impregnated into the coal by conventional means. The effect of temperature on the steam gasification rate shown in Table H indicates that with the present process, steam gasification rates at about 675° C are equivalent to those at 825° C with raw coal.

TABLE H

EFFECT OF TEMPERATURE OF STEAM GASIFICATION ON THE REACTIVITY AND CAKING TENDENCY OF HTT COAL

| Experiment No.[a] | Temp. of Gasification, C | Relative Reactivity, $R_x$[b] | | Final Char Observation | |
|---|---|---|---|---|---|
| | | for x=0.6 | for x=0.7 | Tendency for Swelling and Caking of Coal | Extent of Char (ash) Fusion |
| 31509-42 | 825 | 5.57 | 5.00 | None | None |
| -49 | 725 | 2.95 | 2.94 | None | None |
| -78 | 625 | 0.38 | 0.31 | None | Small |

TABLE H-continued

EFFECT OF TEMPERATURE OF STEAM GASIFICATION ON THE REACTIVITY AND CAKING TENDENCY OF HTT COAL

| Experiment No.[a] | Temp. of Gasification, C | Relative Reactivity, $R_x$[b] | | Final Char Observation | |
|---|---|---|---|---|---|
| | | for x=0.6 | for x=0.7 | Tendency for Swelling and Caking of Coal | Extent of Char (ash) Fusion |
| -81 | 525[c] | — | — | None | None |

[a]All the gasification experiments were performed at 500 psig on a sample that was hydrothermally treated at 250 C for 90 minutes using an NaOH to coal ratio of 0.179, a CaO to coal ratio of 7.5, and a water to coal ratio of 2.8.
[b]The reactivity of raw coal at 825 C is taken to be equal to one.
[c]The rate of gasification was very slow. The relative reactivity for a fractional conversion of 0.4 was 0.039.
—Not determined.

The higher methane yield, to be expected at the lower temperature of gasification, will be an important factor in reducing oxygen consumption during gasification. The higher ratio of methane to carbon oxides achievable at the lower temperature will substantially reduce the endothermicity of the carbon-steam reaction.

The analysis of hydrogasification char for sulfur revealed that, in the case of the HTT coal which contained 7.5 percent calcium, about 88 percent of sulfur present in raw coal was retained by char after 85 percent hydrogasification of coal. On the other hand, only 3 percent sulfur was retained by the char after 84 percent hydrogasification of raw coal. It is believed that the calcium in HTT coal combines with sulfur to form CaS under reducing conditions. The reaction of sulfur with calcium in the case of HTT coal should result in two advantages. First, since the sulfur combines with the added calcium to form CaS combustion of the char in a fluid bed, for example, will allow retention of the sulfur in the ash as $CaSO_4$ which can be disposed of without causing environmental problems. Thus, control of sulfur emissions from SNG plants using high-sulfur coals will not be a problem and can be achieved without stack gas scrubbing.

Second, a reduction of $H_2S$ in the raw product gas will reduce the amount of $H_2S$ that must be removed by scrubbing which should reduce product gas purification costs.

Our data on hydrogasification show that hydrothermal treatment of coal results in the conversion of raw coals, which have a high tendency for swelling, caking, and fusion, to a coal that has a considerably lesser tendency for swelling, caking, and fusion. In comparing the swelling and caking of hydrothermally treated coal with both raw coal and coal treated by impregnating it with CaO as is conventionally done, we have that HTT coal, containing 0.1 percent sodium and 7.5 percent calcium (some of which was present as an oxide and the rest was chemically bound to the coal) did not swell, cake, or fuse together during hydrogasification, while the raw coal and the conventionally-impregnated coal, containing 14.5 wt. percent calcium (20.3 percent CaO), swelled, caked, and severely fused together on steam gasification. The swelling and agglomeration of the conventionally heated coal would have been even more extreme under hydrogasification conditions.

The use of our hydrothermal process to make the coal noncaking is much more attractive than the existing state of the art which involves the preoxidation of coal or the use of rather complicated gasifiers because preoxidation of coal results in the loss of volatile matter, a reduction in the reactivity of coal, and subsequently a lowering of the efficiency of the SNG process. On the other hand our process involves no loss of volatile matter and substantially simpler reactor systems. In addition, preliminary economic analysis indicates that the cost of our process necessary to make the coal noncaking and more reactive may be less than the cost of coal that is burnt during preoxidation.

All of the experiments described above were conducted on bituminous caking coals from the eastern part of the United States, containing about 30 percent volatile matter. Most of our experiments were performed on coal from the Montour mine (Pittsburgh Seam No. 8). A few experiments were performed on coals from the Martinka mine (Lower Kittaning Seam) and the Westland mine (Pittsburgh Seam No. 8).

The gasification experiments were conducted in a thermobalance reactor. A known amount of coal sample (less than 6 g) can be lowered into the preheated reactor zone in less than one minute using a winch assembly. Thus, the reaction times are precisely known and the reactor system can be used to carry out several experiments a day. The reactor can be operated up to 1500 psi and 1200° C.

A large number of the gasification experiments were conducted with hydrogen and steam to determine the effect of catalyst incorporation, using the hydrothermal process, on the reactivity of coal, caking properties of coal, gas analysis and the physical and chemical characteristics of the char. The catalyst-impregnated coal was formed into 3/16-inch diameter × 1/16-inch long cylindrical pellets, without using a binder, since the sample container was made of 100-mesh stainless steel screen.

We claim:

1. A method of treating fine particles of solid carbonaceous fuel of the coal of coke type comprising
   (i) mixing the fuel particles with a liquid aqueous solution comprising essentially (a) sodium or potassium hydroxide together with (b) calcium or magnesium hydroxide or carbonate, or a plurality thereof, with a ratio of (a) to the fuel of about 0.10 to 0.70 by weight, a ratio of (b) to the fuel of about 0.10 to 0.30 by weight, and a ratio of water to the fuel of about 1 to 10 by weight;
   (ii) heating the resulting mixture, at an elevated pressure, and a temperature of about 175° to 300° C in such a manner as to leach soluble components from the fuel particles and to incorporate within the volume thereof a significant amount of calcium or magnesium to provide a gasification catalyst;
   (iii) separating the fuel particles, as a solid phase, from the easily removable liquid phase of the solution; and
   (iv) washing the separated fuel particles; in such manner as to produce a clean, reactive, solid fuel containing a gasification catalyst and adapted for use as a gasification feedstock.

2. A method as in claim 1, wherein the washed fuel particles are subsequently dried.

3. A method as in claim 2, wherein the dried fuel particles are subsequently gasified.

4. A method as in claim 3, wherein the dried fuel particles are gasified with hydrogen.

5. A method as in claim 4, wherein the dried fuel particles are partially gasified with the hydrogen and then gasified with steam.

6. A method as in claim 1, wherein the washed fuel particles are subsequently gasified with steam.

7. A method as in claim 1, wherein the filtered solution is regenerated so that it can be again mixed with unreacted fuel particles.

8. A method as in claim 1, wherein the treating is substantially continuous, comprising the steps of (a) continuously introducing the fuel particles at a preselected rate into the liquid aqueous solution to form a slurry, (b) moving the slurry through a region maintained at the elevated pressure and temperature, (c) moving the slurry outside the region of step (b) and separating the easily removable liquid phase from the solid fuel particles, (d) moving the fuel particles away from the separated liquid phase, and washing the particles.

9. A method as in claim 8, wherein the separated liquid phase is regenerated by removing any impurities therefrom and is recycled as the liquid aqueous solution in the continuous process.

10. A method as in claim 1, wherein the ratio of water to fuel is about 2 to 5 by weight.

11. A method as in claim 1, wherein the solution comprises essentially sodium hydroxide and calcium hydroxide or carbonate.

12. A method as in claim 11, wherein the solution comprises also magnesium hydroxide or carbonate.

13. A method as in claim 1, wherein the ratio of (a) to the fuel is about 0.10 to 0.35 by weight, the ratio of (b) to the fuel is about 0.10 to 0.20 by weight, and the ratio of water to fuel is about 2 to 5 by weight.

14. A method of treating fine particles of solid carbonaceous fuel of the coal or coke type comprising (i) mixing the fuel particles with a liquid aqueous solution comprising essentially (a) sodium, potassium, or lithium hydroxide together with (b) calcium, magnesium, or barium hydroxide or carbonate, or a plurality thereof, with a ratio of (a) to the fuel of about 0.04 to 0.07 by weight, a ratio of (b) to the fuel of about 0.02 to 0.30 by weight, and a ratio of water to the fuel of about 1 to 10 by weight;

(ii) heating the resulting mixture, at an elevated pressure, to a temperature of about 150° to 375° C in such a manner as to leach sulfur and ash from the fuel particles into the solution and to incorporate within the volume of the particles a significant amount of calcium, magnesium, or barium, or a plurality thereof;

(iii) separating the fuel particles, as a solid phase, from the easily removable liquid phase of the solution; and (iv) washing the separated fuel particles; in such manner as to produce a clean, solid fuel having a lowered sulfur and sodium, potassium, or lithium content while containing calcium, magnesium, or barium, or a plurality thereof, to combine with sulfur remaining in the fuel particles during combustion, pyrolysis, or gasification thereof, whereby the combined sulfur can be retained in the char or the ash of the fuel.

15. A method as in claim 14, wherein the mixture is filtered to separate the fuel particles from the solution.

16. A method as in claim 15, wherein the filtered solution is regenerated so that it can be again mixed with unreacted fuel particles.

17. A method as in claim 14, wherein the washed fuel particles are subsequently dried.

18. A method as in claim 14, wherein the treating is substantially continuous, comprising the steps of (a) continuously introducing the fuel particles at a preselected rate into the liquid aqueous solution to form a slurry, (b) moving the slurry through a region maintained at the elevated pressure and temperature, (c) moving the slurry outside the region of step (b) and separating the easily removable liquid phase from the solid fuel particles, (d) moving the fuel particles away from the separated liquid phase, and washing the particles.

19. A method as in claim 18, wherein the separated liquid phase is regenerated by removing any impurities therefrom and is recycled as the liquid aqueous solution in the continuous process.

20. A method as in claim 14, wherein the ratio of water to fuel is about 2 to 5 by weight.

21. A method as in claim 14, wherein the solution comprises essentially sodium hydroxide and calcium hydroxide or carbonate.

22. A method as in claim 21, wherein the solution comprises also magnesium hydroxide or carbonate.

23. A method of treating fine particles of solid carbonaceous fuel of the coal or coke type comprising, (i) mixing the fuel particles with a liquid aqueous solution comprising essentially (a) sodium, potassium, or lithium hydroxide together with (b) calcium, magnesium, or barium hydroxide or carbonate, or a plurality thereof, with a ratio of (a) to the fuel of about 0.04 to 0.07 by weight, a ratio of (b) to the fuel of about 0.02 to 0.30 by weight, and a ratio of water to the fuel of about 1 to 10 by weight; and (ii) heating the resulting mixture, at an elevated pressure, to a temperature of about 150° to 375° C in such a manner as to improve the usefulness of the fuel particles.

24. A method as in claim 23, wherein the mixture is subsequently cooled to below about 100° C.

25. A method as in claim 24, wherein the cooled mixture is filtered to separate the fuel particles from the solution.

26. A method as in claim 25, wherein the filtered fuel particles are subsequently washed.

27. A method as in claim 26, wherein the washed fuel particles are subsequently dried.

28. A method as in claim 24, wherein the cooled mixture is subsequently dried.

29. A method as in claim 26, wherein the filtered solution is regenerated so that it can be again mixed with unreacted fuel particles.

30. A method as in claim 23, wherein the treating is substantially continuous, comprising the steps of (a) continuously introducing the fuel particles at a preselected rate into the liquid aqueous solution to form a slurry, (b) moving the slurry through a region maintained at the elevated pressure and temperature, (c) moving the slurry outside the region of step (b) and separating the easily removable liquid phase from the solid fuel particles, (d) moving the fuel particles away from the separated liquid phase, and washing the particles.

31. A method as in claim 30, wherein the separated liquid phase is regenerated by removing any impurities therefrom and is recycled as the liquid aqueous solution in the continuous process.

32. A method as in claim 23, wherein the ratio of (a) to the fuel is about 0.10 to 0.70 by weight.

33. A method as in claim 23, wherein the ratio of (b) to the fuel is about 0.08 to 0.30 by weight.

34. A method as in claim 23, wherein the ratio of water to fuel is about 2 to 5 by weight.

35. A method as in claim 23, wherein the solution comprises essentially sodium hydroxide and calcium hydroxide or carbonate.

36. A method as in claim 35, wherein the solution comprises also magnesium hydroxide or carbonate.

37. A method as in claim 23, wherein the mixture is maintained at a temperature of about 175° to 300° C.

38. A method as in claim 37, wherein the ratio of (a) to the fuel is about 0.10 to 0.70 by weight, the ratio of (b) to the fuel is about 0.08 to 0.30 by weight, and the ratio of water to fuel is about 2 to 5 by weight.

39. A method as in claim 37, wherein the ratio of (a) to the fuel is about 0.10 to 0.35 by weight, the ratio of (b) to the fuel is about 0.10 to 0.20 by weight, and the ratio of water to the fuel is about 2 to 5 by weight.

* * * * *